United States Patent [19]

Radford et al.

[11] Patent Number: 5,053,739

[45] Date of Patent: Oct. 1, 1991

[54] VERY HIGH ENERGY ABSORBING VARISTOR

[75] Inventors: Kenneth C. Radford, North Huntingdon, Pa.; Robert G. Johnson; Andrew S. Sweetana, Jr., both of Bloomington, Ind.

[73] Assignee: Electric Power Research Institute, Palo Alto, Calif.

[21] Appl. No.: 452,261

[22] Filed: Dec. 15, 1989

[51] Int. Cl.[5] ..... H01C 7/10

[52] U.S. Cl. ..... 338/21; 252/517

[58] Field of Search ..... 338/20, 21; 252/517-521

[56] References Cited

U.S. PATENT DOCUMENTS 3,872,582 3/1975 Matsuoka et al. ..... 338/20 X 4,169,071 9/1979 Eda et al. ..... 338/21 X

*Primary Examiner*—Marvin M. Lateef

*Attorney, Agent, or Firm*—James B. Hinson

[57] ABSTRACT

A varistor utilizing a disc of mainly ZnO in combination with preselected combinations of $Bi_2O_3$, $Sb_2O_3$, $SiO_2$, MgO and CaO.

5 Claims, 1 Drawing Sheet

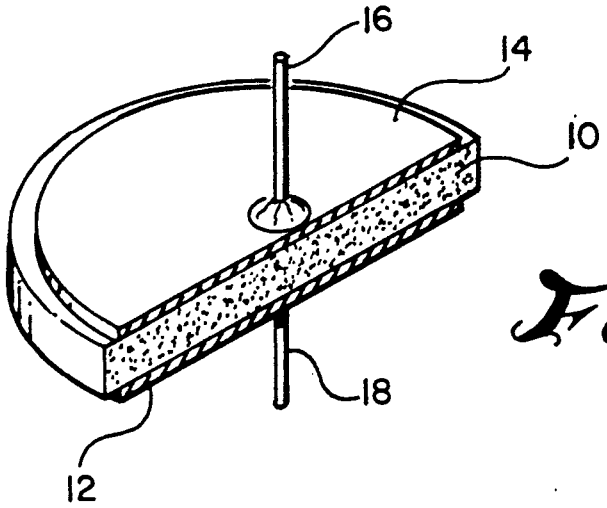
Fig. 1
Fig. 2
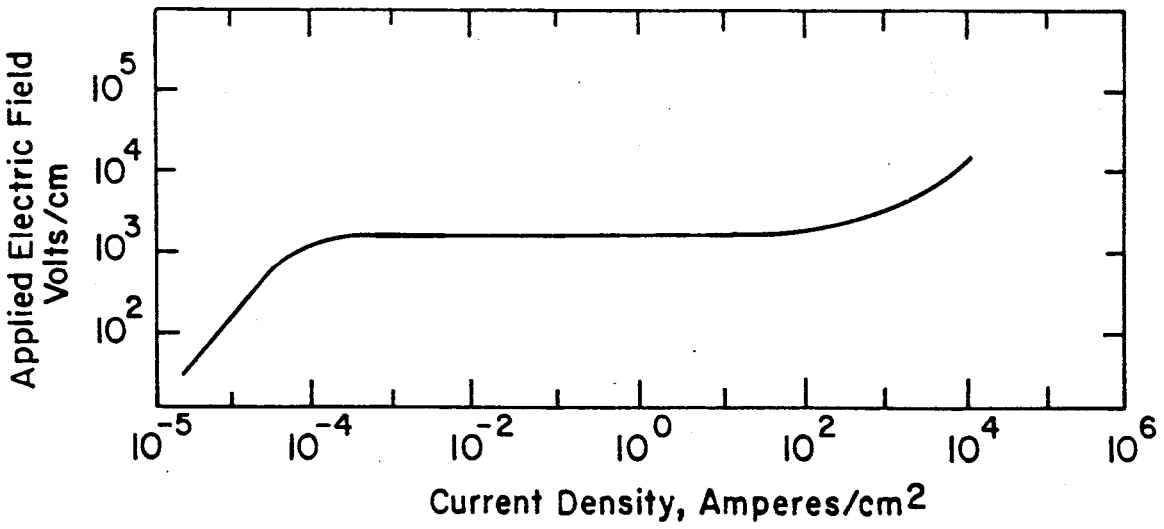

VERY HIGH ENERGY ABSORBING VARISTOR

BACKGROUND OF THE INVENTION

1. Field of the Invention

The invention relates to varistors and more specifically to varistors having high energy absorption.

2. Summary of the Prior Art

Varistors having high energy absorption capabilities are difficult to fabricate. This difficulty is due to the complex chemical nature of the varistor mixture. Varistors are mainly composed of zinc oxide in combination with selected quantities of $Bi_2O_3$, $Sb_2O_3$, $Co_3O_4$, $MnO_2$, $SiO_2$ and smaller levels of B, K, or Na, and $Al_2O_3$. Energy is absorbed in the varistor by Joule heating with the ZnO grains acting as heat sinks.

Increasing the grain size to increase energy absorption through traditional ceramic procedures of extending sintering times or higher sintering temperatures is possible, but other electrical properties are adversely affected. Additionally, the varistor may lose portions of the key constituents due to their volatile nature at high sintering temperature. Components of the mixture that are lost at higher sintering temperatures include $Sb_2O_3$, B, K and, in particular, $Bi_2O_3$. Loss of these materials results in an increase in porosity of the disc, causing the maximum energy absorption to be reduced. Stated alternatively, a particular time/temperature combination produces maximum absorption, with a decrease in absorption occurring with either higher sintering temperature or reduced processing time.

In order to overcome the detrimental effects of extending sintering time, a more refractory chemical composition was desired which would tolerate the higher processing temperatures required to grow the larger ZnO grains. In addition, the chemical composition needed to be such that the other electrical parameters of the varistor were not degraded. The disclosed invention meets these requirements.

SUMMARY OF THE INVENTION

The invention comprises a varistor having increased energy absorption. The energy absorption is achieved by utilizing a specific critical combination of key materials which permit an increase in the sintering temperature time without degrading the other parameters of the varistor.

DESCRIPTION OF THE DRAWINGS

FIG. 1 is a drawing of a typical varistor.

FIG. 2 is a curve illustrating the voltage current characteristics of a typical varistor.

DETAILED DESCRIPTION

As is well known in the prior art, the process of constructing varistor discs requires the materials used in forming the disc be ground and combined to form a mixture. Portions of the mixture are pressed into the desired shape and sintered in an oxygen atmosphere to form a ceramic disc. Leads are attached to the disc to provide for electrical connection and suitable packaging is provided to complete the varistor.

A typical varistor is illustrated in FIG. 1. It includes the varistor disc 10 which has electrodes, 10 and 12, affixed to the opposed sides thereof. Leads, 16 and 18, are attached to the electrodes provide means for connecting the varistor into the electrical circuit.

At a low voltage stress, the current flowing through the varistor is low and the characteristic is essentially linear. As the voltage stress increases above a selected point, the current increases at a very rapid rate. In application, the characteristics of the varistor disc are selected such that at the operating voltage stress, the current through the varistor is low (typically less than 0.5 ma/cm$^2$.) However, with voltage or current surges which increase the voltage stress to which the varistor is subjected, the current increases very rapidly, dissipating high levels of energy and limiting the aptitude of the voltage surge. The voltage/current characteristic of a typical varistor is illustrated in FIG. 2.

Functioning of the varistor to limit transients is dependent on absorbing energy. Thus, it is clearly desirable that the energy absorption of the varistor material be as high as practical. In prior art varistors, the energy absorption per cubic centimeter was typically less than 500 J/cc. It is desirable to increase this energy absorption, thus reducing the size of varistor discs for a particular application.

The varistor which is the subject of this patent application provides a varistor disc having high energy absorption coupled with good electrical characteristics.

In developing the varistor which is the subject matter of this patent application, the materials comprising the mixture were prepared by the normal practice of milling, spray drying, pressing the disc, and sintering at a temperature of 1300° C. for two hours. After sintering, the discs were lapped, annealed at 600° C. for two hours, the electrodes were applied and the varistors were electrically tested.

The basic electrical parameters were measured by subjecting the disc to a voltage stress of $E_{0.5}$ and measuring the parameters at room temperature. ($E_{0.5}$ is the voltage stress at which a current of 5 ma/cm$^2$ flows.) The energy absorption was obtained by subjecting the disc to a 60 Hz voltage at $E_{1.1}$ until failure with the energy absorption was recorded. The high temperature stability was measured by subjecting these varistors to a temperature of 250° C. at a voltage stress of 0.7 $E_{0.5}$ and measuring the time required for the current to increase to 5 mA/cm$^2$.

In service, the discs are continuously subjected to line voltage and will operate at some temperature slightly above ambient due to the leakage current heating. After passage of a transient power surge, the leakage current is slightly higher due to the temperature dependence of the V/I characteristic. It is necessary that the disc remain thermally stable during this time period so that the heat from the surge can be dissipated without the varistor exhibiting an uncontrolled increase in leakage current, leading to a failure. The high temperature stability test at 250° C. provides a measure of this stability of the varistor during intervals of high energy absorption. The reported high temperature stability intervals is the time required for the varistor current to reach 5 Ma/cm$^2$ at the specified test conditions.

In developing the varistor comprising the invention, varistor mixtures including varied amounts of $Bi_2O_3$, $Sb_2O_3$, $SiO_2$, MgO and CaO and smaller amounts of other ingredients were constructed and electrically tested. Each of these mixtures was given an arbitrary identification number with the results of the these tests tabulated below. The room temperature leakage current, RTiR, and the non-linearity exponent (alpha) measured between 0.5 ma/cm$^2$ to 250 A/cm$^2$ are important varistor characteristics and are also shown in the table.

| Comp | $Bi_2O_3$ m/o | $Sb_2O_3$ m/o | $SiO_2$ m/o | MgO m/o | CaO m/o | $E_{0.5}$ v/cm | R.T. iR $uA/cm^2$ | STAB Mins | ENERGY $J/cm^3$ | ALPHA |
|---|---|---|---|---|---|---|---|---|---|---|
| 963 | 1.0 | 1.5 | 0.5 | 0.5 | 0.05 | 1404 | 5.9 | 88 | 777 | 24 |
| 941 | 1.0 | 1.0 | 0.5 | 0.5 | 0.05* | 1232 | 4.8 | 125 | 539 | 24 |
| 931 | 1.0 | 1.0 | 0.5 | 0.5 | 0.05 | 1198 | 5.3 | 350 | 833 | 24 |
| 964 | 1.0 | 1.0 | 0.25 | 0.5 | 0.05 | 1180 | 5.7 | 209 | 1167 | 23 |

*0.01 m/o BaO added (m/o = mole percent)

Based on the results, it is clear that the mixture in accordance with the invention (labeled) allows a reduction in the $Sb_2O_3$ level and produces a varistor having high energy absorption capability. A reduction in the $SiO_2$ content is also necessary in order to achieve the indicated performance.

We claim:

1. A varistor utilizing a disc, said disc formed by sintering a mixture in accordance with a predetermined sintering cycle, said mixture comprising primarily Zno in combination with selected additives, said additives including a selected concentration of $Bi_2O_3$ in the range of 1.0 M/O, a selected concentration of $Sb_2O_3$ in the range of 1.0 M/O, s selected concentration of $SiO_2$ in the range of 0.25 M/O, a selected concentration of MgO in the range of 0.5 M/O, and a selected concentration of CaO in the range of 0.05 M/O, with the remainder comprising primarily ZnO.

2. A varistor disc in accordance with claim 1 wherein said preselected sintering cycle includes at least two portions; said first portion during which said mixture is sintered at a temperature in the range of 1300° C.

3. A varistor disc in accordance with claim 2 wherein said preselected sintering cycle includes at least a second portion during which said disc is subjected to an annealing cycle in the range of 200° C.

4. A method for making a varistor disc, said varistor disc being formed by sintering a mixture in accordance with a predetermined sintering cycle, said method including the steps of:

a) preparing a mixture including, a concentration of $Bi_2O_3$ in the range of 1.0 M/O, a concentration of $Sb_2O_3$ in the range of 1.0 M/O, a concentration of $SiO_2$ in the range of 0.25 M/O, a concentration of MgO in the range of 0.5 M/O, a concentration of CaO in the range of 0.05 M/O;

b) sintering preselected quantities of said mixture to form said disc at a first temperature in the range of 1300° C.; and c) annealing said disc at a second temperature in the range of 600° C.

5. A method of making a varistor disc in accordance with claim 4 further including the step of preparing said mixture such that the reminder of said mixture is substantially ZnO.

* * * * *